US005480138A

United States Patent [19]

Haupenthal et al.

[11] Patent Number: 5,480,138

[45] Date of Patent: Jan. 2, 1996

[54] DEVICE FOR SHEET-FORMAT ADJUSTMENT OF A SHEET-TRANSFER DRUM

[75] Inventors: Rudi Haupenthal, Epfenbach; Maurice Lämmerzahl, Heidelberg, both of Germany

[73] Assignee: Heidelberger Druckmaschinen AG, Heidelberg, Germany

[21] Appl. No.: 240,926

[22] Filed: May 10, 1994

[30] Foreign Application Priority Data

May 10, 1993 [DE] Germany ..... 43 15 513.8

[51] Int. Cl.[6] ..... B65H 5/02

[52] U.S. Cl. ..... 271/276; 271/277

[58] Field of Search ..... 271/275–277; 198/471.1

[56] References Cited

U.S. PATENT DOCUMENTS 4,043,548 8/1977 Pollich ..... 271/275 X 4,357,870 11/1982 Rudolph et al. ..... 271/277 X

*Primary Examiner*—David H. Bollinger

*Attorney, Agent, or Firm*—Herbert L. Lerner; Laurence A. Greenberg

[57] ABSTRACT

Device for sheet-format adjustment of a sheet-transfer drum formed of sheet-holding segments displaceable in guides radially and in a rotational direction of the sheet-transfer drum, and having gripper devices for holding leading and trailing edges of sheets, the gripper devices being adjustable with respect to one another in an outer cylindrical surface of the sheet-transfer drum in the rotational direction thereof, the sheet-holding segments and the gripper devices being simultaneously adjustable for two sheets to be transported, includes guide discs disposed on both sides of the sheet-transfer drum and fixedly connected to a shaft of the sheet-transfer drum, the guide discs being formed with radial guide slots extending parallel to one another, and at least one guide element connected to a sheet-holding segment and being seated in each of the guide slots, and a respective control disc disposed on each side of the sheet-transfer drum and rotatable on the shaft of the sheet-transfer drum, the control disc being associated with the respective guide disc and being connected to at least one cross-member, the at least one guide element being seated in a control slot formed in the control disc, the control slot having a radial guiding component, the gripper devices for holding the sheet trailing edge being disposed on the at least one cross-member, at least one of the control discs being connected to a driving element for rotating the control discs relative to the guide discs on the shaft of the sheet-transfer drum.

5 Claims, 5 Drawing Sheets

DEVICE FOR SHEET-FORMAT ADJUSTMENT OF A SHEET-TRANSFER DRUM

SPECIFICATION

The invention is related to a device for sheet-format adjustment of a sheet-transfer drum usable in sheet-fed rotary printing presses wherein sheet-transfer drums are provided for conveying the sheets, gripper positions and sheet-holding surfaces of the sheet-transfer drums having to be set to a new sheet format or size whenever there is a job change.

The published German Patent Document DE 35 35 621 Cl describes a sheet-transfer drum with such a device. The sheet-transfer drum serves to transport two sheets, which are held at their front edge in grippers and at their rear edge by means of suction-type grippers on the outer cylindrical surface of the sheet-transfer drum. The sheet-holding surface is formed by outer cylindrical-surface segments which, together with the suction-type grippers, are disposed on a common mount. For setting to a new sheet size, the mount is of flexible construction and is insertable into a guide channel having, as viewed in the drum rotation direction, an outer section as well as a further inner section. Through a partial insertion of the mount into the inner section, the sheet-holding surface can be reduced continuously or steplessly in the direction of rotation of the sheet-transfer drum in accordance with the sheet format or size which is to be printed. A disadvantage of this construction is that, when a setting is made to a new sheet format or size, the outer-cylindrical-surface elements must cover a relatively large rotational-angle range, and that the outer-cylindrical-surface segments, on a path into the inner section, pass a connecting channel having a narrow radius and causing a reversal of the direction of motion between that of the outer lying and the inner lying outer cylindrical-surface segments. This lengthens the time required for a change-over operation as well as the downtime of a printing press associated therewith. The guidance of the outer cylindrical-surface segments from the outside to the inside requires an elaborate construction due to the reversal of the direction of motion in the interior of the sheet-transfer drum. A setting to a new sheet format or size can be performed manually or automatically, for which purpose position-measuring devices and remotely controllable motorized drive systems may be provided (German Utility Patent (DE GM) 83 19 431 and published German Patent Document DE 31 36 349 Al).

Further devices for sheet-size or format adjustment have become known heretofore wherein two sheet-holding segments interlock in the rotation direction, the sheet-holding segments being rotatable relative to one another about a common shaft (Japanese Patents 4-153039 and 4-1588041). A disadvantage of these constructions is that the sheet-holding segments forming the sheet-holding surface are formed with slots and edges, respectively, transverse to the rotation direction of the sheet-transfer drum, the respective slots and edges possibly adversely affecting the printing quality whenever the sheets lie, with their printed side down, on the outer cylindrical surface of the sheet-transfer drum.

Published European Patent Document 0 165 477 Al describes a covering for a sheet-transfer drum, the covering embodying an outer cylindrical surface on which a printed side of a sheet can be transported unharmed. In another embodiment of this construction, for changing over to a new sheet format or size, a storage drum is provided, in the vicinity of the trailing sheet edges, with a suction box adjustable in the direction of rotation. A disadvantage thereof is that the adjustment range between a maximum and a minimum sheet size or format is small for reasons inherent to the design.

The cylinder for a printing press described in German Utility Patent (DE GM) 91 15 526 has an outer cylindrical surface broken down into ring zone-shaped or matrix-shaped sub-elements each of which is independently retractable by remote control in the radial spacing thereof. The sub-elements may be retracted by mechanical, electrodynamic, pneumatic or hydraulic driving means which exclusively permit a radial motion of the sub-elements.

This construction has the disadvantage that a multiplicity of actuating elements are required, which are both material and cost-intensive.

It is accordingly an object of the invention to provide a device for the sheet-size or format adjustment of a sheet-transfer drum which permits, by relatively simple means, a rapid change-over to a new sheet size or format, with the sheet-carrying outer cylindrical surface having only slight surface discontinuities.

With the foregoing and other objects in view, there is provided, in accordance with the invention, a device for sheet-format adjustment of a sheet-transfer drum formed of sheet-holding segments displaceable in guides radially and in a rotational direction of the sheet-transfer drum, and having gripper devices for holding leading and trailing edges of sheets, the gripper devices being adjustable with respect to one another in an outer cylindrical surface of the sheet-transfer drum in the rotational direction thereof, the sheet-holding segments and the gripper devices being simultaneously adjustable for two sheets to be transported, comprising guide discs disposed on both sides of the sheet-transfer drum and fixedly connected to a shaft of the sheet-transfer drum, the guide discs being formed with radial guide slots extending parallel to one another, and at least one guide element connected to a sheet-holding segment and being seated in each of the guide slots, and a respective control disc disposed on each side of the sheet-transfer drum and rotatable on the shaft of the sheet-transfer drum, the control disc being associated with the respective guide disc and being connected to at least one cross-member, the at least one guide element being seated in a control slot formed in the control disc, the control slot having a radial guiding component, the gripper devices for holding the sheet trailing edge being disposed on the at least one cross-member, at least one of the control discs being connected to a driving element for rotating the control discs relative to the guide discs on the shaft of the sheet-transfer drum.

In accordance with another feature of the invention, the device includes two guide pins serving as guide elements for each sheet-holding segment on either side of the sheet-transfer drum, the guide slots and the control slots being matched in width with the diameter of the guide pins.

In accordance with a further feature of the invention, the sheet-holding segments are lamellar in form.

In accordance with an added feature of the invention, adjacent sheet-holding segments in the direction of the generating line of the outer cylindrical surface of the sheet-transfer drum have a plurality of rectangular teeth lying perpendicularly in the rotational direction of the sheet-transfer drum.

In accordance with a concomitant feature of the invention, parallel to the rotational shaft in the rotational direction of the sheet-transfer drum, the sheet-holding segments are of cutting-edge construction and form a closed surface in the outer cylindrical surface of the sheet-transfer drum, the radially extending guide slots formed in the guide discs extend in curve-shaped form, and the sheet-holding segments directed away from the outer cylindrical surface are imbricated or shingled.

Thus, guide discs with radial guide slots are provided on each side of the sheet-transfer drum on the shaft thereof. The guide slots of the guide discs extend parallel to one another. Running with virtually zero play in the guide slots are guide elements, each of which is connected to at least one sheet-holding segment disposed adjustably in the rotational direction of the sheet-transfer drum and in the radial direction. Furthermore, the object of the invention is achieved in that control discs are disposed next to the guide discs on the shaft of the sheet-transfer drum. The guide discs are fixedly connected to the shaft, while the control discs are rotatably seated on the shaft. The control discs are connected to at least one cross-member, transversely to the rotational direction of the sheet-transfer drum. The gripper elements for holding a sheet trailing edge are disposed on one of the cross-members. Planar surfaces of the control discs which are associated with the guide discs are provided with control slots in which there runs at least one of the guide elements connected to the sheet-holding segments. The control slots have a section with a radial guiding component. At least one of the control discs is connected to a driving element for the rotation of the control discs with respect to the guide discs.

The ink-repelling sheet-holding segments may be lamellar in form, adjacent sheet-holding segments in the direction of the generating line of the outer cylindrical surface of the sheet-transfer drum possibly having a plurality of rectangular teeth disposed perpendicularly in the rotational direction.

An especially closed outer cylindrical surface is achieved when the sheet-holding segments have a cutting-edge construction and the radially extending guide slots of the guide discs extend in a curve-shaped form, with the result that the sheet-holding segments, directed away from the outer cylindrical surface, are imbricated or shingled. Other features which are considered as characteristic for the invention are set forth in the appended claims.

Although the invention is illustrated and described herein as embodied in a device for format-adjustment of a sheet-transfer drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
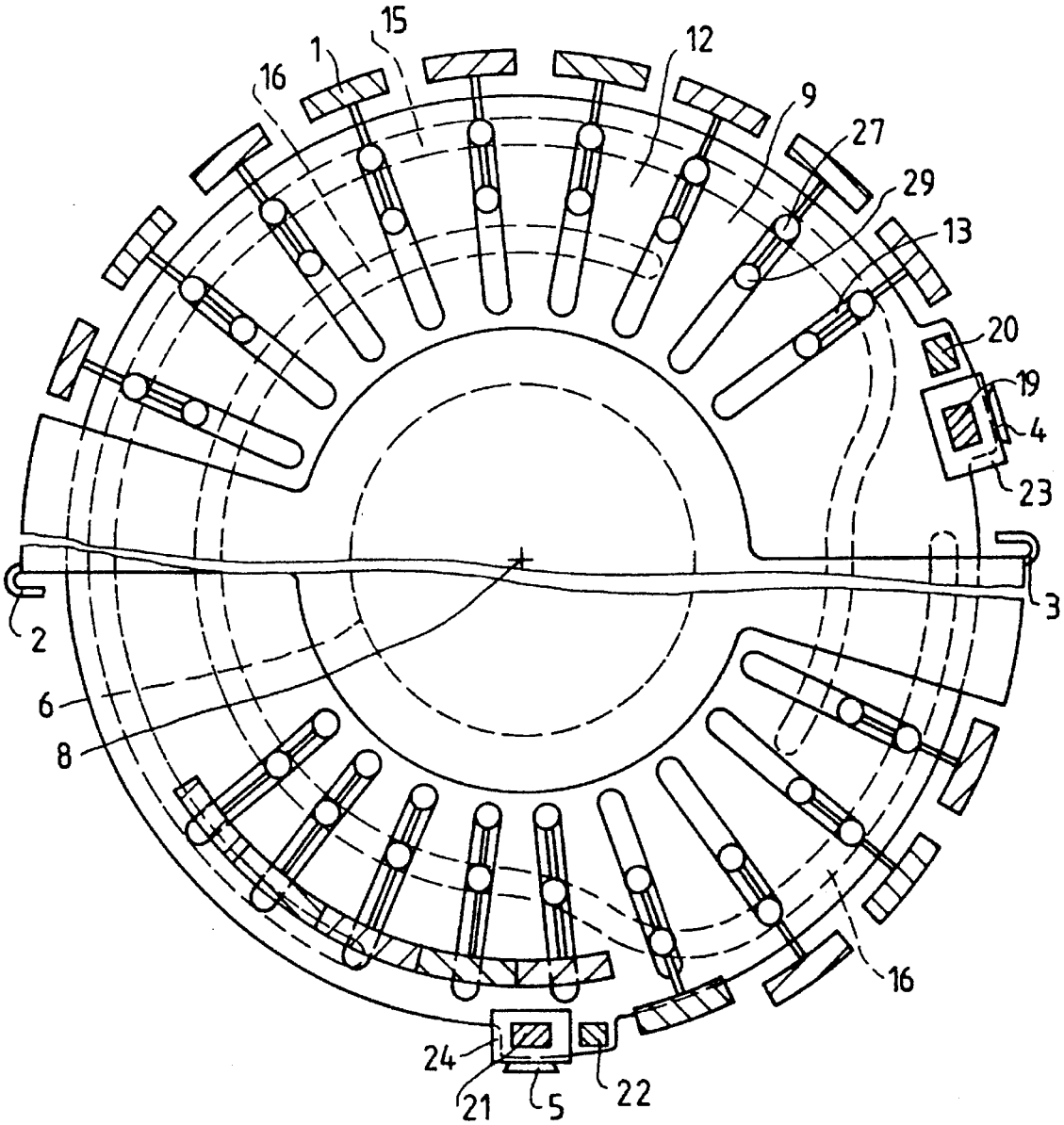
FIG. 1 is a cross-sectional view of a sheet-transfer drum for two different sheet sizes or formats.

Referring now to the drawing and, first, particularly to FIG. 1 thereof, there is shown therein a sheet-transfer drum formed of a multiplicity of sheet-holding segments 1 having radially outer limiting surfaces which form the sheet-holding surfaces for a maximum of two sheets to be transported. Two rows of grippers 2, 3 are provided on the sheet-transfer drum in order to hold the sheet leading edges. Trailing edges of the sheets are held by means of suction-type grippers 4, 5 on the sheet-transfer drum. The upper half of FIG. 1 shows the sheet-holding segments for a maximum sheet size or format. The positions of the sheet-holding segments 1 in the lower half of FIG. 1 correspond to the position for a smaller sheet size or format.

Figure 2:
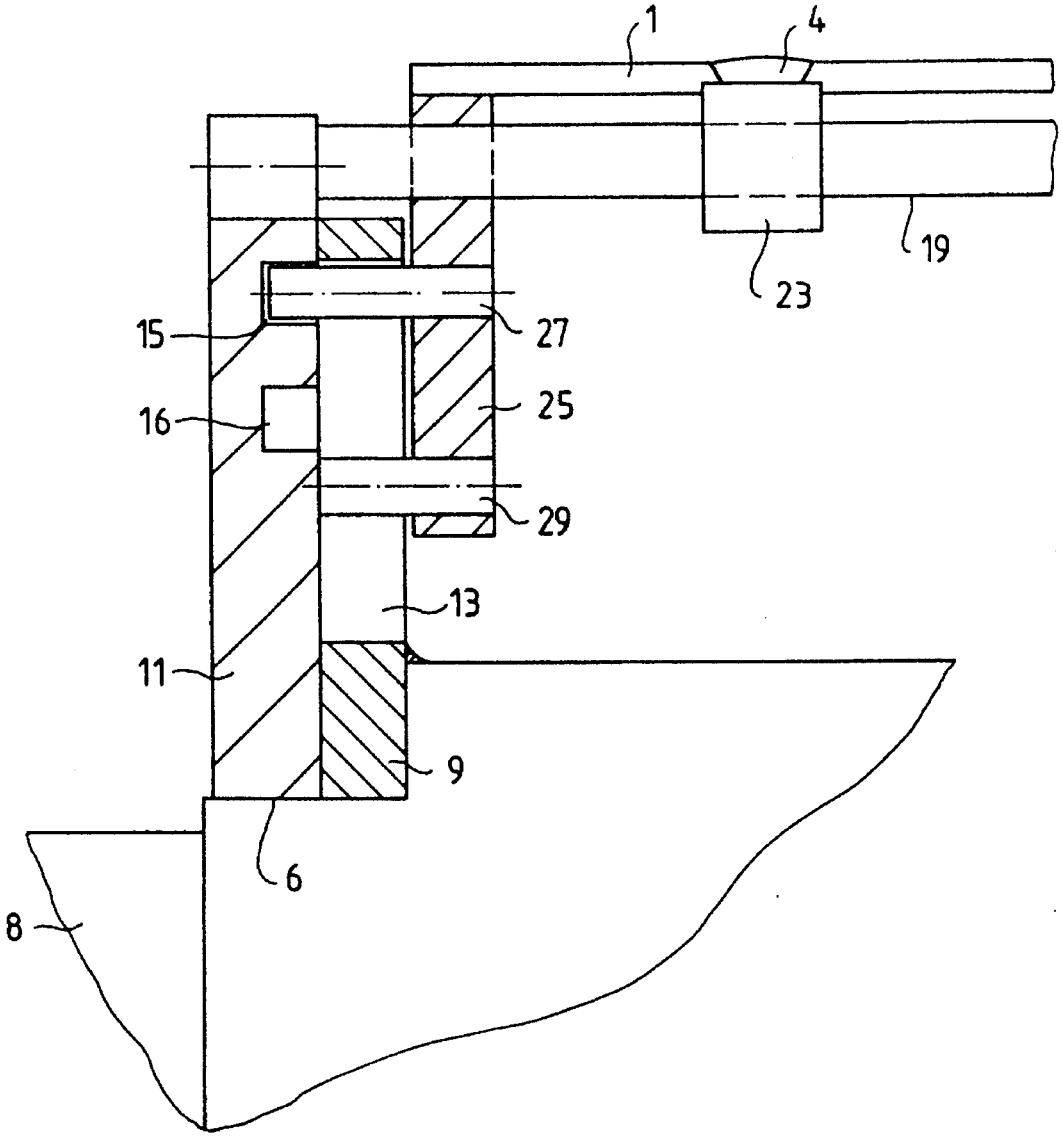
FIG. 2 is an enlarged fragmentary longitudinal sectional view of FIG. 1.
Figure 3:
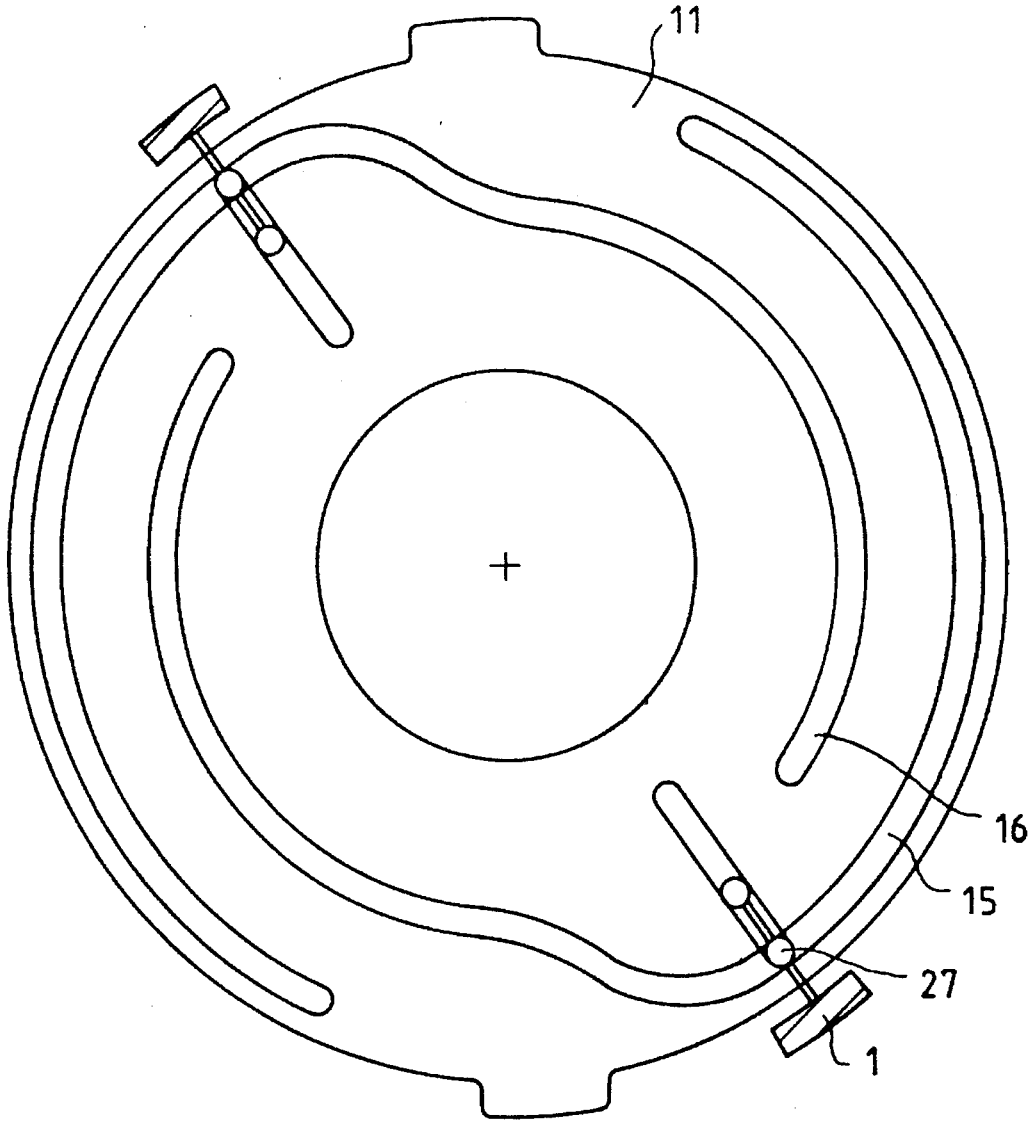
FIG. 3 is a view similar to that of FIG. 1 providing a detailed representation of a control disc forming part of the invention.

As shown in FIGS. 1 and 2, inner-lying guide discs 9, 10 and outer-lying control discs 11, 12 are situated on bearing seats 6, 7 of a shaft 8 on either side of the sheet-transfer drum. The control disc 11 is shown in detail in FIG. 3. The guide discs 9, 10 are fixedly seated on the shaft 8, while the control discs 11, 12 are rotatably disposed on the bearing seats 6, 7. The guide discs 9, 10 are formed with radial guide slots 13, 14 which lie parallel in the radial direction. The control discs 11, 12 are provided with control slots 15, 16, 17, 18, which extend, respectively, in a defined range on a circular path about the shaft 8 and which extend radially inwardly in a further angular range. The control discs 11, 12 are bolted together by two cross-members 19, 20 and 21, 22 on each half of the sheet-transfer drum. Holders 23, 24 for suction-type grippers 4, 5 are attached to the cross-members 19 and 21, the suction-type grippers 4, 5 holding the sheet trailing edge. The sheet-holding segments 1 are connected on both sides thereof to radially disposed supports 25, 26, which are each provided with two guide pins 27, 28, 29, 30. The diameter of the guide pins 27, 28, 29, 30 is matched to the width of the guide slots 13, 14 and of the control slots 15, 16, 17, 18. The guide pins 27, 28 run in the guide slots 13, 14 and in the control slots 15, 17, while the guide pins 29, 30 run only in the guide slots 13, 14.

In order to change the sheet-holding segments 1 over from the maximum sheet size or format to a minimum sheet size or format, the cross-members 19, 20, 21, 22 are moved across the sheet-holding segments 1 with the holders 23, 24. The control discs 11, 12 may be connected to a driving element for this purpose. When the control discs 11, 12 are rotated with respect to the guide discs 9, 10 on the bearing seats 6, 7, the guide pins 27, 28 are moved radially towards the shaft 8 into the range of the control slots 15, 17 provided with a radial component. At the same time, the guide pins 27, 28, 29, 30, connected to the supports 25, 26, are moved radially towards the shaft 8 in the guide slots 13, 14. The guide slots 13, 14 serve as straight guides and prevent tilting of the sheet-holding segments 1 during sheet-size or format change-over. Due to the connection via the supports 25, 26, the sheet-holding segments 1 are simultaneously moved inwardly.

Figure 4:
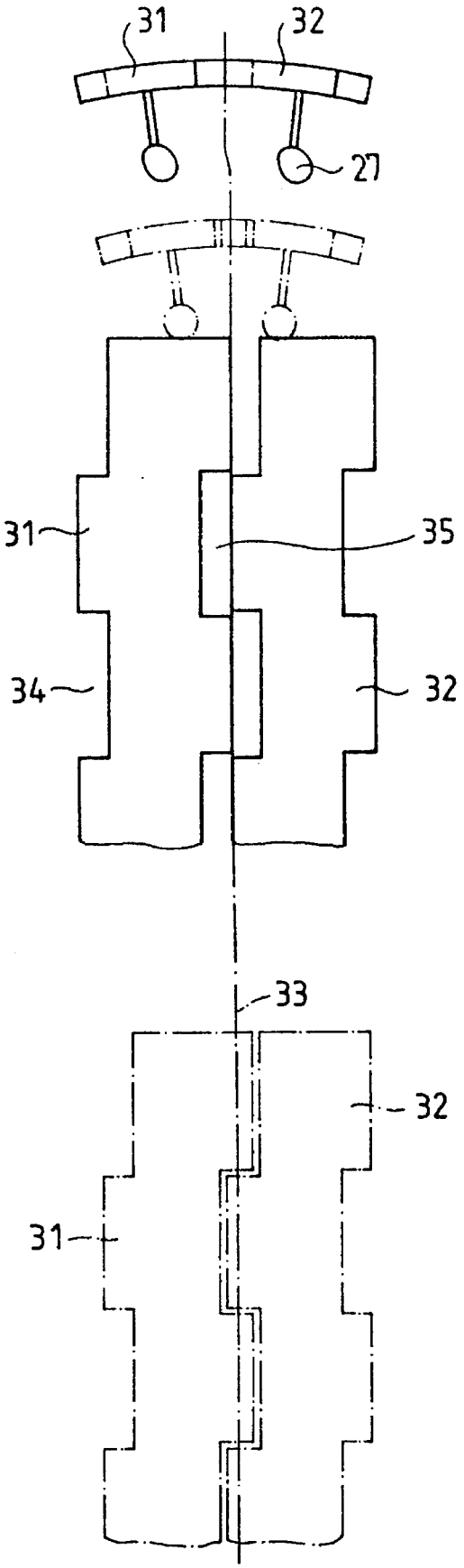
FIG. 4 is a diagrammatic view of toothed sheet-holding segments.

The sheet-holding segments 31, 32 shown in FIG. 4 are provided on either side with rectangular cut-outs 34, 35 in the direction of a generating line 33. In the solid-line representation, the sheet-holding segments 31, 32 are in the plane of the outer cylindrical surface. In the broken-line representation, the sheet-holding segments 31, 32 are inwardly retracted as described hereinbefore. The sheet-holding segments 31, 32 are telescoped into one another at the cut-outs. This ensures that no slots extending across the entire width of a sheet inside the outer cylindrical surface are able to influence the printing quality.

Figure 5:
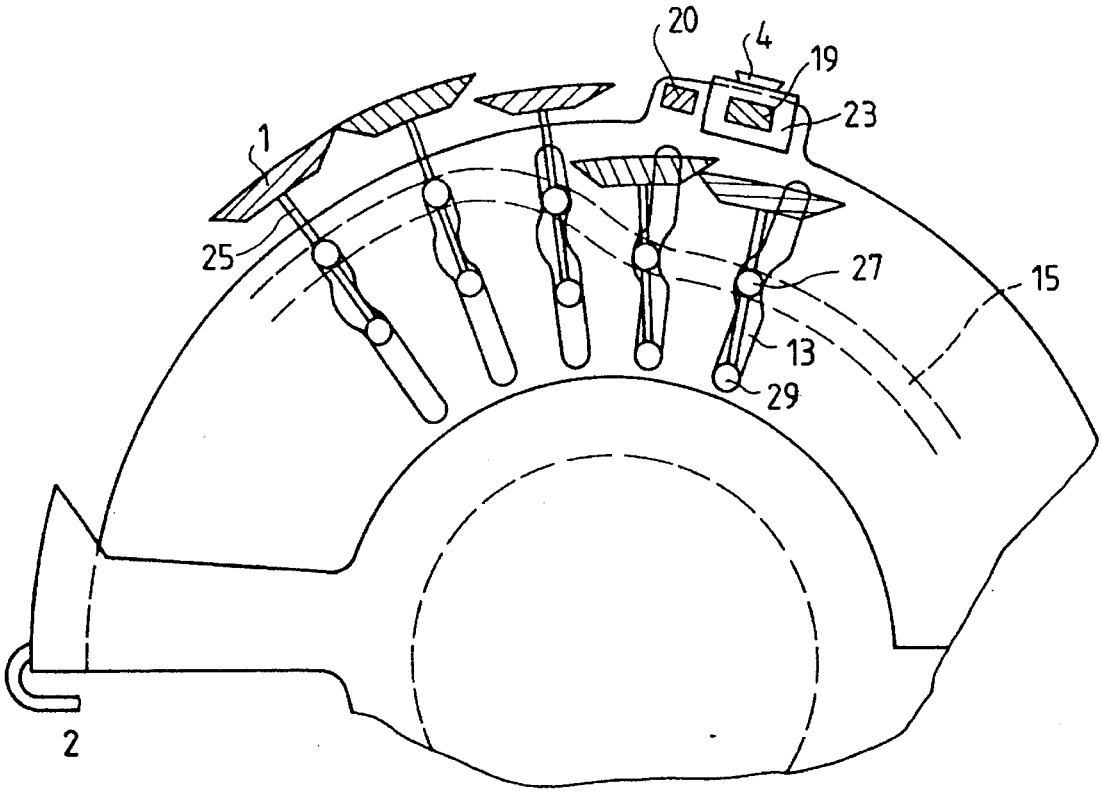
FIG. 5 is an enlarged fragmentary view of FIG. 1 showing undercut sheet-holding segments.
Figure 5A:
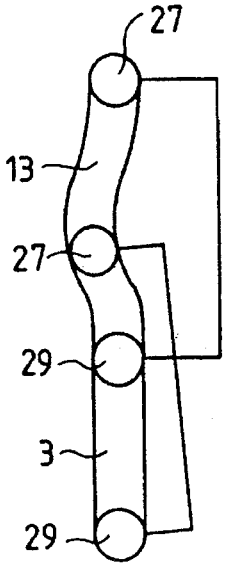
FIG. 5*a* is an enlarged fragmentary view of FIG. 5.

In another embodiment shown in FIG. 5, the sheet-holding segments 1 have a cutting edge-shaped construction. This ensures that there are no slots between the sheet-holding segments 1 in the outer cylindrical surface. The guide slots 13, 14 are not straight, but have a curve-shaped form as is more clearly shown in FIG. 5*a*. When the control discs 11, 12 are rotated with respect to the guide discs 9, 10, the sheet-holding segments 1 are thereby swivelled in the guide slots 13, 14 about an angle. Due to the cutting-edge construction, the retracted sheet-holding segments 1 are imbricated or shingled.

We claim:

1. Device for sheet-format adjustment of a sheet-transfer drum having a shaft, the device comprising sheet-holding segments displaceable in guides radially and in a rotational direction of the sheet-transfer drum, guide discs disposed on both sides of the sheet-transfer drum and fixedly connected to the shaft of the sheet-transfer drum, said guides including mutually parallel guide slots formed in said guide discs, and at least one guide element connected to one of said sheet-holding segments and being seated in each of said guide slots, and a respective control disc disposed on each side of the sheet-transfer drum and rotatable on the shaft of the sheet-transfer drum, said control disc being associated with the respective guide disc and being connected to at least one cross-member, said at least one guide element being seated in a control slot formed in said control disc, said control slot having a radial guiding component, and gripper devices for holding leading and trailing edges of sheets, said gripper devices for holding the sheet trailing edge being disposed on said at least one cross-member, at least one of said control discs being connected to a driving element for rotating said control discs relative to said guide discs on said shaft of the sheet-transfer drum.

2. Device according to claim 1, wherein said at least one guide element is a plurality of guide elements formed of two guide pins serving as guide elements for each sheet-holding segment on either side of the sheet-transfer drum, said guide slots and said control slots being matched in width with a diameter of said guide pins.

3. Device according to claim 1, wherein the sheet-holding segments are lamellar in form.

4. Device according to claim 3, wherein an outer cylinddrical surface of the sheet transfer drum has a generating line defined thereon, and wherein adjacent sheet-holding segments in the direction of the generating line have a plurality of rectangular teeth lying perpendicularly in the rotational direction of the sheet-transfer drum.

5. Device according to claim 1, wherein, parallel to the rotational shaft in the rotational direction of the sheet-transfer drum, the sheet-holding segments are of cutting-edge construction and form a closed surface in the outer cylindrical surface of the sheet-transfer drum, said radially extending guide slots formed in said guide discs extend in curve-shaped form, and the sheet-holding segments directed away from the outer cylindrical surface are imbricated or shingled.

* * * * *